US006714175B1

(12) United States Patent
Shimada et al.

(10) Patent No.: US 6,714,175 B1
(45) Date of Patent: Mar. 30, 2004

(54) PLASMA DISPLAY PANEL AND METHOD FOR DRIVING THE PANEL

(75) Inventors: Yojiro Shimada, Kawasaki (JP); Kenji Yoshida, Kawasaki (JP); Seiki Kurogi, Kagoshima (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/537,345

(22) Filed: Mar. 29, 2000

(30) Foreign Application Priority Data

Oct. 28, 1999 (JP) ..... 11-306206

(51) Int. Cl.[7] ..... G09G 3/28
(52) U.S. Cl. ..... 345/60; 345/67; 315/169.4
(58) Field of Search ..... 345/60, 67, 71; 315/169.4

(56) References Cited

U.S. PATENT DOCUMENTS 5,656,893 A * 8/1997 Shino et al. ..... 313/582
5,877,734 A * 3/1999 Amemiya ..... 315/169.4
6,157,128 A * 12/2000 Namiki et al. ..... 313/581
6,479,932 B1 * 11/2002 Nunomura ..... 313/582

FOREIGN PATENT DOCUMENTS

EP 0 855 691 A1 * 7/1998 ..... G09G/3/28
JP 6-44907 2/1994

* cited by examiner

*Primary Examiner*—Amare Mengistu
*Assistant Examiner*—Jimmy H. Nguyen
(74) *Attorney, Agent, or Firm*—Staas & Halsey LLP

(57) ABSTRACT

A plasma display panel with high accuracy of addressing is provided by suppressing spread of address discharge in the column direction. The plasma display panel includes first main electrodes and second main electrodes for row selection and address electrodes for column selection. A discharge space is continuous over the full length of the screen in each column. The address electrode is patterned in such a way that each first area opposed to the second main electrode is smaller than each second area opposed to the metal film of the first main electrode, in corresponding third areas between partitions of each column of the display panel.

18 Claims, 6 Drawing Sheets

PLASMA DISPLAY PANEL AND METHOD FOR DRIVING THE PANEL

BACKGROUND OF THE INVENTION

1. Field of the Invention

The present invention relates to a plasma display panel (PDP) of surface discharge type and the method for driving the PDP.

A plasma display panel is used widely for a television set or a computer monitor after the color display thereof has been successfully commercialized. In order to attain further wide use of the PDP, the structure thereof that is suitable for high definition is developing.

2. Description of the Prior Art

As a color display device, an AC type PDP having three-electrode surface discharging structure is commercialized. The surface discharge type has a first and second main electrode as anodes and cathodes arranged in parallel on the front and the back substrates in the display discharge securing intensity. As an electrode matrix structure of the surface discharge type plasma display panel, a "three-electrode structure" is known well in which third electrodes (address electrodes) are arranged so as to cross the main electrodes. One of the main electrode pair is used as a scanning electrode for row selection, so that address discharge is generated between the scanning electrode and the address electrode. Thus, addressing is performed for controlling wall discharge in accordance with contents of display. After the addressing, a sustaining voltage having alternating polarity is applied to the main electrode pair, so that the surface discharge is generated along the surface of the substrate only in the cell having a certain quantity of the wall charge.

A basic three-electrode structure has a pair of main electrodes arranged in each row of the screen. The distance between the main electrode pairs in each row (a surface discharge gap length) is set to a few tens of microns so that the discharge can occur by the application of 150–200 volts.

On the contrary, the distance between the electrodes of the neighboring rows (referred to as an inverse slit) is set to the value that is sufficiently larger than (as large as a few times) the surface discharge gap length so as to prevent undesired surface discharge between rows and to decrease the capacitance. Namely, the distance between the main electrodes of a row is different from that between rows. Another three-electrode structure has N+1 main electrodes (N is the number of rows in the screen) spaced uniformly. The neighboring electrodes constitute an electrode pair for generating the surface discharge. Main electrodes, except those at opposite ends of the arrangement, are related to the neighboring two rows. In the plasma display panel having this structure, interlaced scanning is performed for display.

The surface discharge type plasma display panel having the three-electrode structure includes partitions (i.e., barrier ribs) for defining the discharge space of each row. A stripe pattern of the partition in which partitions having a ribbon shape as a plan view are arranged has an advantage compared with a mesh pattern in which each cell is isolated. In the stripe pattern, the discharge space is continuous over the full length of the screen in each column. Therefore, the discharge probability can be increased by priming, fluorescent layer can be made uniform, and the exhausting process can be, performed easily. As the structure having the discharge space that is continuous in the row direction, a two-layer structure is also known, in which the mesh pattern and the stripe pattern are combined in the height direction.

In the conventional panel structure in which the discharge space is continuous in the column direction, there is a problem as follows. The address discharge in the row selected for addressing spreads excessively in the column direction, and undesired charge is accumulated in the area adjacent to the address electrode in the row neighboring the selected row. When the neighboring row becomes the selected row later, the charge that has been accumulated can lower the address voltage applied to the cell. The lowered address voltage cannot cause an address discharge, and incorrect addressing causes fluctuations of display. Especially in the structure having main electrodes spaced uniformly this can cause addressing errors easily.

SUMMARY OF THE INVENTION

An object of the present invention is to suppress the growing of the address discharge in the column direction so that the addressing accuracy can be improved.

In the present invention, the shape or the position of the address electrode is arranged so that the opposed area of the main electrode that is not used for row selection opposed to the address electrode via the decreased discharge space can be decreased. Thus, the address discharge is localized in the opposed portion of the address electrode, i.e., the portion opposed to the main electrode and to be used for row selection.

If the main electrode is made of a transparent conductive film and a metal film, the portion of the metal film opposed to the address electrode causes the address discharge. Therefore, the area of the metal film of the main electrode to be used for row selections opposed to the address electrode, is set sufficiently large so that the reliability of the address discharge can be secured.

According to a first aspect of the present invention, the plasma display panel includes a plurality of first main electrodes for row selection, a plurality of second main electrodes constituting electrode pairs with plural first main electrodes for generating surface discharge on each row, a plurality of address electrodes for column selection, and partitions for defining a discharge space for each column, which is continuous over the full length of the screen. The first main electrodes and the second main electrodes are arranged alternately. Each of the first main electrodes and the second main electrodes includes a transparent conductive film for securing electrode area and a metal film for reducing electric resistance. Each of the address electrodes crosses at least the metal film of the first main electrodes and is patterned in such a way that the area, opposed to the metal film, of the second main electrode is smaller than the area opposed to the metal film, of the first main electrode in the area between the partitions of each column of the screen.

According to a second aspect of the present invention, the first main electrodes and the second main electrodes are spaced uniformly.

According to a third aspect of the present invention, the first main electrodes and the second main electrodes are spaced uniformly and the transparent conductive films of the first main electrodes and the second main electrodes are patterned so as to protrude, at each end of the metal film overlaying thereon, in the column direction and so as to form a T-shape.

According to a fourth aspect of the present invention, each of the address electrodes crosses the metal film of the first main electrodes at the center of the area in the row direction.

According to a fifth aspect of the present invention, each of the address electrodes is patterned in a linear ribbon shape, whose width changes periodically, so that the width at the portion crossing the metal films of the first main electrodes is larger than that at the portion crossing the metal films of the second main electrode.

According to a sixth aspect of the present invention, the first main electrodes and the second main electrodes are spaced uniformly, the transparent conductive films of the first main electrodes and the second main electrodes are patterned so as to protrude, at each end of the metal film overlaying thereon, in the column direction and so as to form a T-shape, each of the address electrodes is patterned in a linear ribbon shape and whose width changes periodically so that the width at the portion crossing the metal films of the first main electrodes is larger than that at the portion crossing the metal films of the second main electrode, and each of the address electrodes is arranged at the center of the area in the row direction.

According to a seventh aspect and a twelfth aspect of the present invention, a method of driving a plasma display panel is provided. The method comprises the steps of displaying odd fields and even fields of an object image; controlling a potential of each of the first main electrodes and the address electrodes independently so as to perform addressing of odd rows, and then applying a voltage for generating surface discharge to the electrode pair of the odd row periodically, while displaying odd fields, and controlling a potential of each of the first main electrodes and the address electrodes one by one so as to perform addressing of even rows, and then applying a voltage for generating surface discharge to the electrode pair of the even rows periodically, while displaying even fields.

According to an eighth aspect of the present invention, a plasma display panel is provided that includes a plurality of first main electrodes for row selection, a plurality of second main electrodes constituting electrode pairs with the plural first main electrodes for generating surface discharge on each row, a plurality of address electrodes for column selection, and partitions for defining a discharge space for each column, which is continuous over the full length of the screen. The first main electrodes and the second main electrodes are arranged alternately. Each of the plural address electrodes is patterned so as to cross the first main electrodes and not to cross the second main electrodes in the area between the partitions of each row in the screen.

According to a ninth aspect of the present invention, the portions of the address electrodes crossing the second main electrodes are insulated by the partition from the discharge space.

According to a tenth aspect of the present invention, the first main electrodes and the second main electrodes are spaced uniformly.

According to an eleventh aspect of the present invention, the first main electrodes and the second main electrodes are spaced uniformly and the transparent conductive films of the first main electrodes and the second main electrodes are patterned so as to protrude at each end of the metal film overlaying thereon in the column direction and so as to form a T-shape.

DESCRIPTION OF THE PREFERRED EMBODIMENTS

Figure 1:
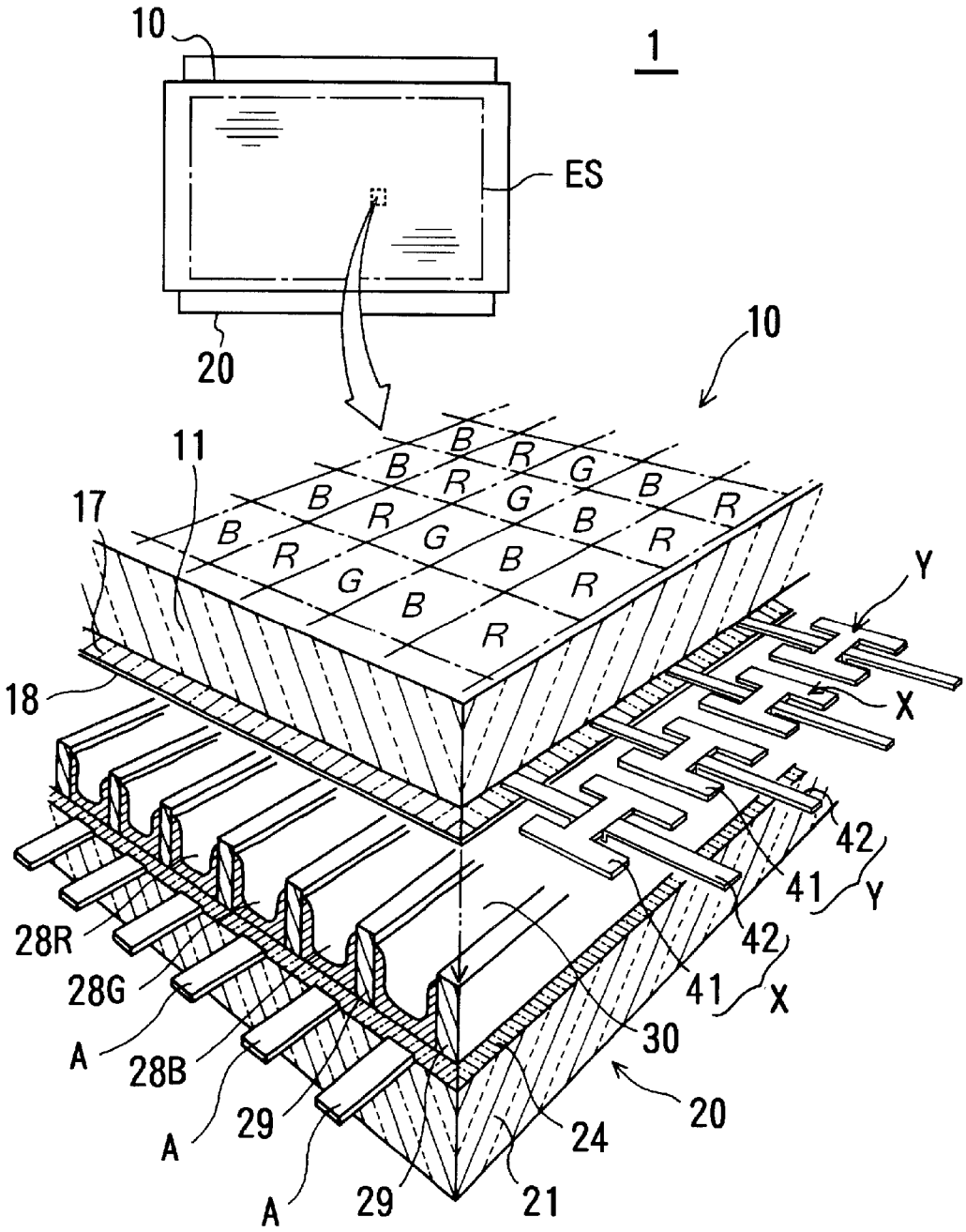
FIG. 1 is a diagram showing the internal construction of a plasma display panel according to the present invention.

FIG. 1 is a diagram showing the internal construction of a plasma display panel according to the present invention.

The illustrated plasma display panel 1 is an AC type color plasma display panel having a surface discharge structure having a pair of substrata structures, or substrates, 10, 20. In each cell (display element) making up a screen, a pair of main electrodes X, Y cross an address electrode A that is patterned in a special shape unique to the present invention. The main electrodes X, Y are arranged alternately and spaced uniformly on the inner surface of the glass plate 11 of the front side substrata structure 10. Each of the main electrodes X, Y includes a transparent conductive film 41 that defines a surface discharge gap for each cell and a metal film (a bus electrode) 42 in a linear ribbon shape extending over the full length of the row. The metal film 42 has a three-layer structure such as chrome-copper-chrome, and is disposed at the center of the transparent conductive film 41 in the column direction. These main electrodes X, Y are covered with a dielectric layer 17 having thickness of approximately 30–50 $\mu$m, and the dielectric layer 17 is covered with a protection layer 18 of magnesia (MgO).

The address electrode A is arranged on the inner surface of the glass plate 21 of the back side substratal structure 20 and is covered with a dielectric layer 24. On the dielectric layer 24, a partition 29, like a linear ribbon in a plan view and having a height of 150 $\mu$m, is disposed between the address electrodes A. The partitions 29 define a discharge space 30 in the row direction (the horizontal direction of the screen ES), and determine the gap size of the discharge space 30. The inner surface of the back side including the upper portion of the address electrode A and the side face of the partition 29 is covered with three colors R, G and B of fluorescent layers 28R, 28G and 28B for color display. The discharge space 30 is filled with a discharge gas including neon as a main component mixed with xenon. The fluorescent layers 28R, 28G and 28B are pumped to emit light locally by the ultraviolet rays emitted by the xenon upon discharge. One pixel of display includes three subpixels arranged in the row direction. The structure in each subpixel is the cell C. The arrangement pattern of the partition 29 is a stripe pattern, so that the discharge space 30 corresponding to each column portion is continuous over all rows in the column direction.

Figure 2A:
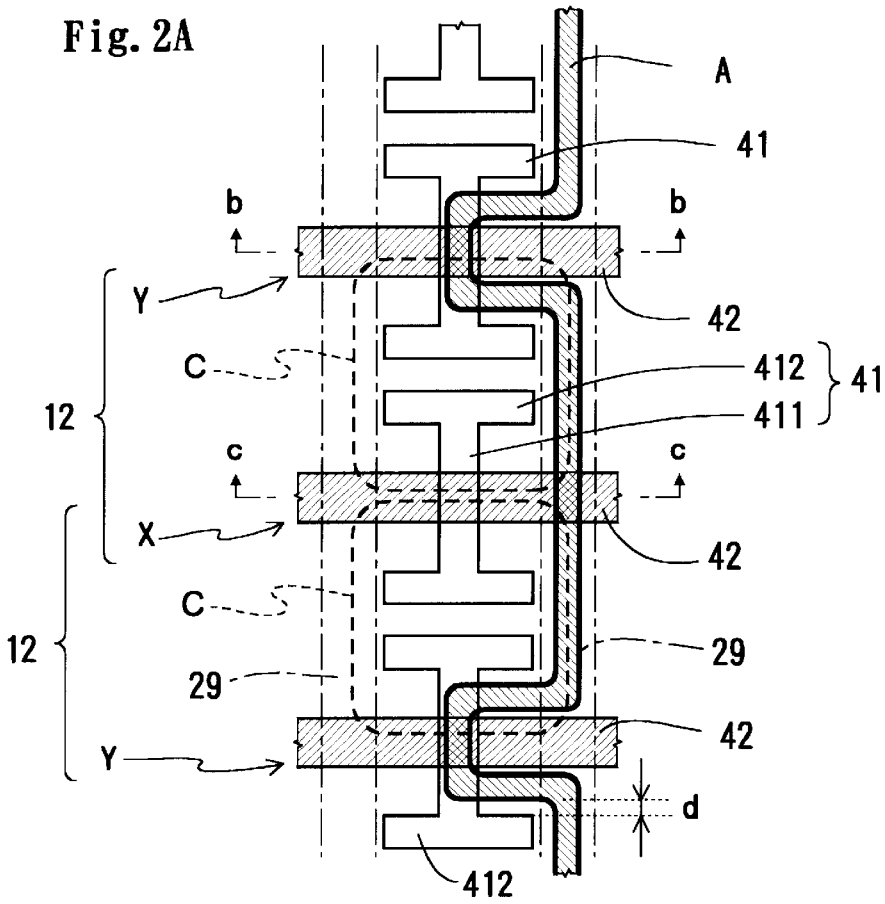
FIGS. 2A–2C show the positional relationship between the main electrode and the address electrode.
Figure 2B:
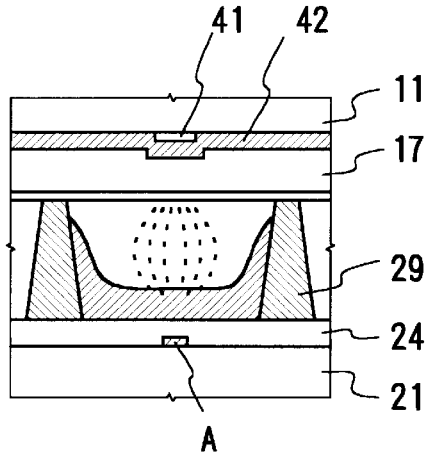
Figure 2C:
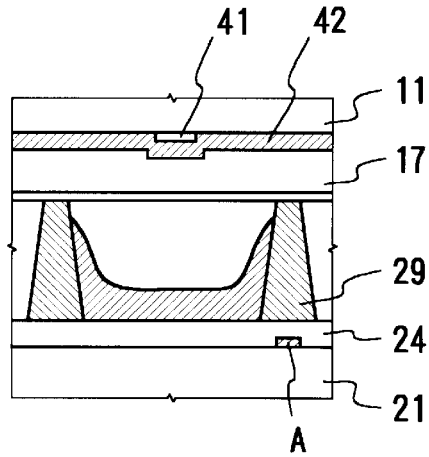

FIGS. 2A–2C show the positional relationship between the main electrode and the address electrode. FIGS. 2B and 2C are a b-b cross section and a c-c cross section of FIG. 2A, respectively.

In the screen, the shape of the main electrode X and the main electrode Y as plan views are the same. In the uniformly spaced main electrodes X, Y, the main electrode X and the main electrode Y being adjacent to each other constitute an electrode pair 12 for generating the surface discharge, and define a row. Namely, main electrodes X, Y—except for the ends of the arrangement—work for displaying two rows (an odd row and an even row). The main electrode X on each end works for displaying rows. The row is a set of cells C having the same arrangement order in the column direction. In the illustrated example, the transparent conductive film 41 of the main electrodes X, Y includes a belt portion 411 in the column direction and belt portions 412 in the row direction that are connected to respective, opposite ends of the belt portion 411. Thus, transparent conductive film 41 of the main electrodes X, Y is patterned so as to protrude, at each end of the metal film 42, in the column direction in a T-shape. The transparent conductive film 41 is not limited to the illustrated shape that is independent for each cell, but can be continuous over the full length of the screen in the row direction. Since each of the main electrodes X, Y is shaped to protrude from the metal film 42 in the column direction, symmetrically in the T-shape, the surface discharge can be localized in the area around the surface discharge gap so that the definition can be improved in the column direction. In addition, since the belt portions 412 are spaced in the row direction and the main electrode gap is enlarged periodically along the row direction to be larger than the surface discharge gap, the capacitance becomes smaller than the case where the main electrode gap is constant over the full length of the row direction, so that the drive characteristics are improved. In addition, since the electrode area becomes smaller and the discharge current is decreased, the required current capacity of the drive circuit can be relieved.

The address electrode A is patterned in a meandering ribbon shape that crosses the metal film 42 of the main electrode Y used for row selection at the center of the row direction and does not cross the metal film 42 of the main electrode X in the area between the partitions 29. Namely, the address electrode A is curved so as to avoid the transparent conductive film 41 of the main electrode X, and crosses the metal film 42 of the main electrode X under the partition 29. This patterning enables the address electrode A substantially to cross only the main electrode Y, so that the address discharge is localized in the vicinity of each main electrode Y, and the interference of address discharge between neighboring rows is prevented. If the main electrode has the illustrated shape, a predetermined gap d between the belt portion 412 of the main electrode Y and the address electrode A improves the effect of protecting the spread of discharge.

Since the width of the address electrode A is uniform, the distance between the neighboring address electrodes A is constant along the column direction, and the capacitance between rows becomes the minimum value. In order to increase the area of the address electrode A opposed to the main electrode Y, the width of the address electrode A can be enlarged partially.

Figure 3:
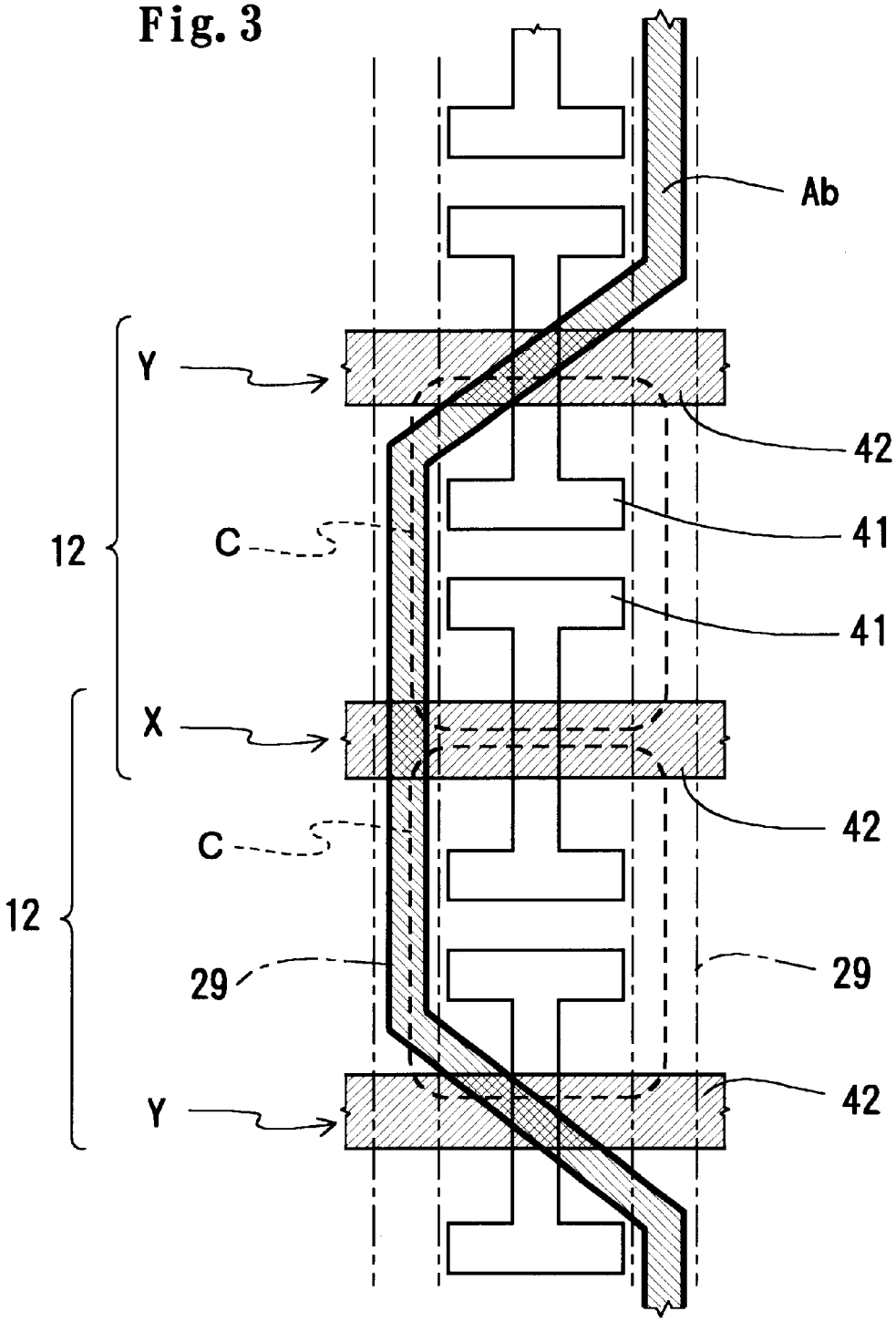
FIG. 3 shows a second example of the shape of the address electrode.
Figure 4:
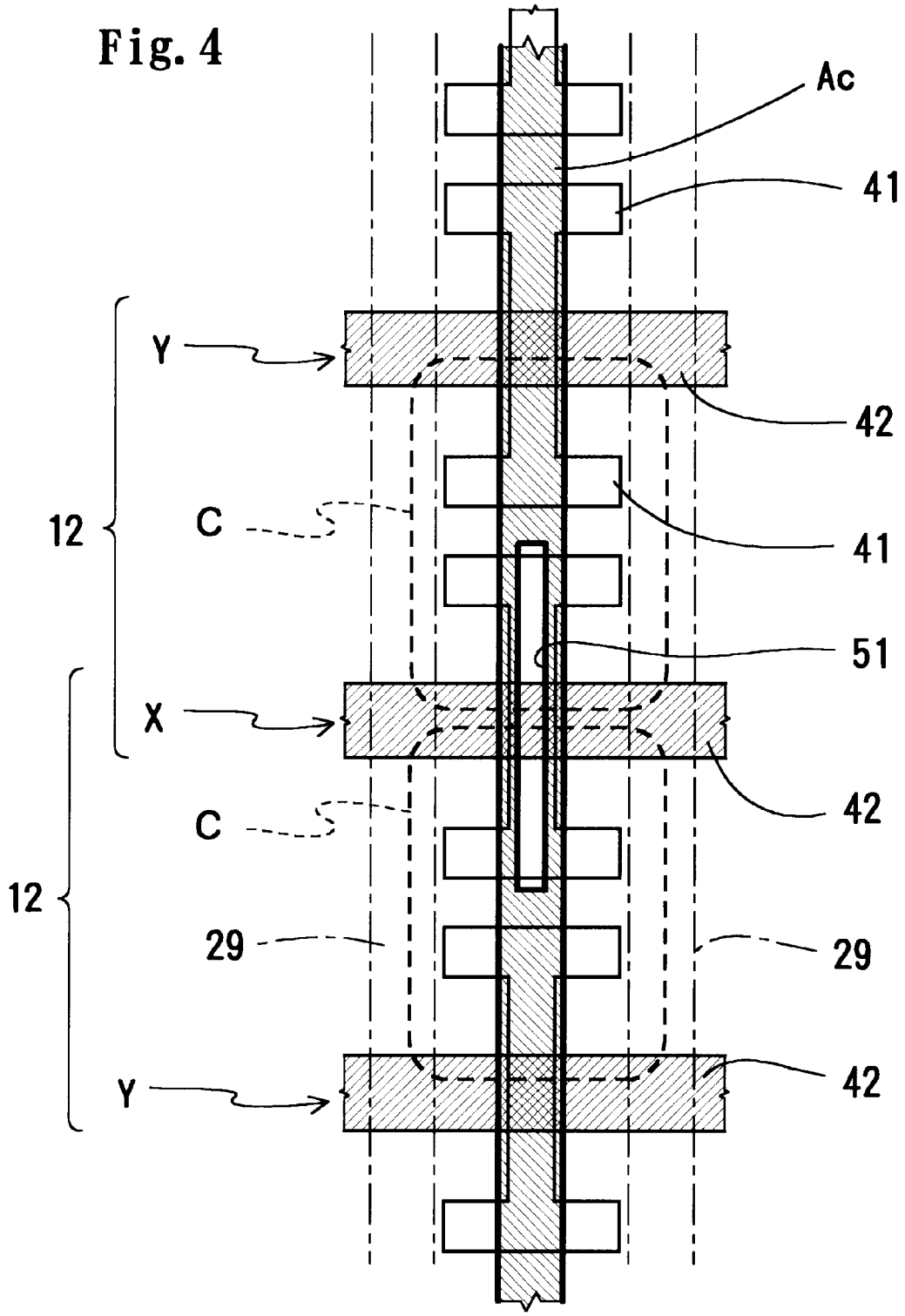
FIG. 4 shows a third example of the shape of the address electrode.

FIG. 3 shows a second example of the shape of the address electrode. FIG. 4 shows a third example of the shape of the address electrode.

In FIG. 3, the address electrode Ab is patterned so as to avoid the transparent conductive film 41 of the main electrode X and to cross each in the row direction. In FIG. 4, the address electrode Ac is patterned in a linear ribbon shape having a slit 51 and is arranged in the center of the row in the row direction. The slit 51 makes the area of the main electrode X opposed to the address electrode A smaller than the area of the main electrode Y opposed to the address electrode A, so that the spread of the address discharge is prevented.

Figure 5:
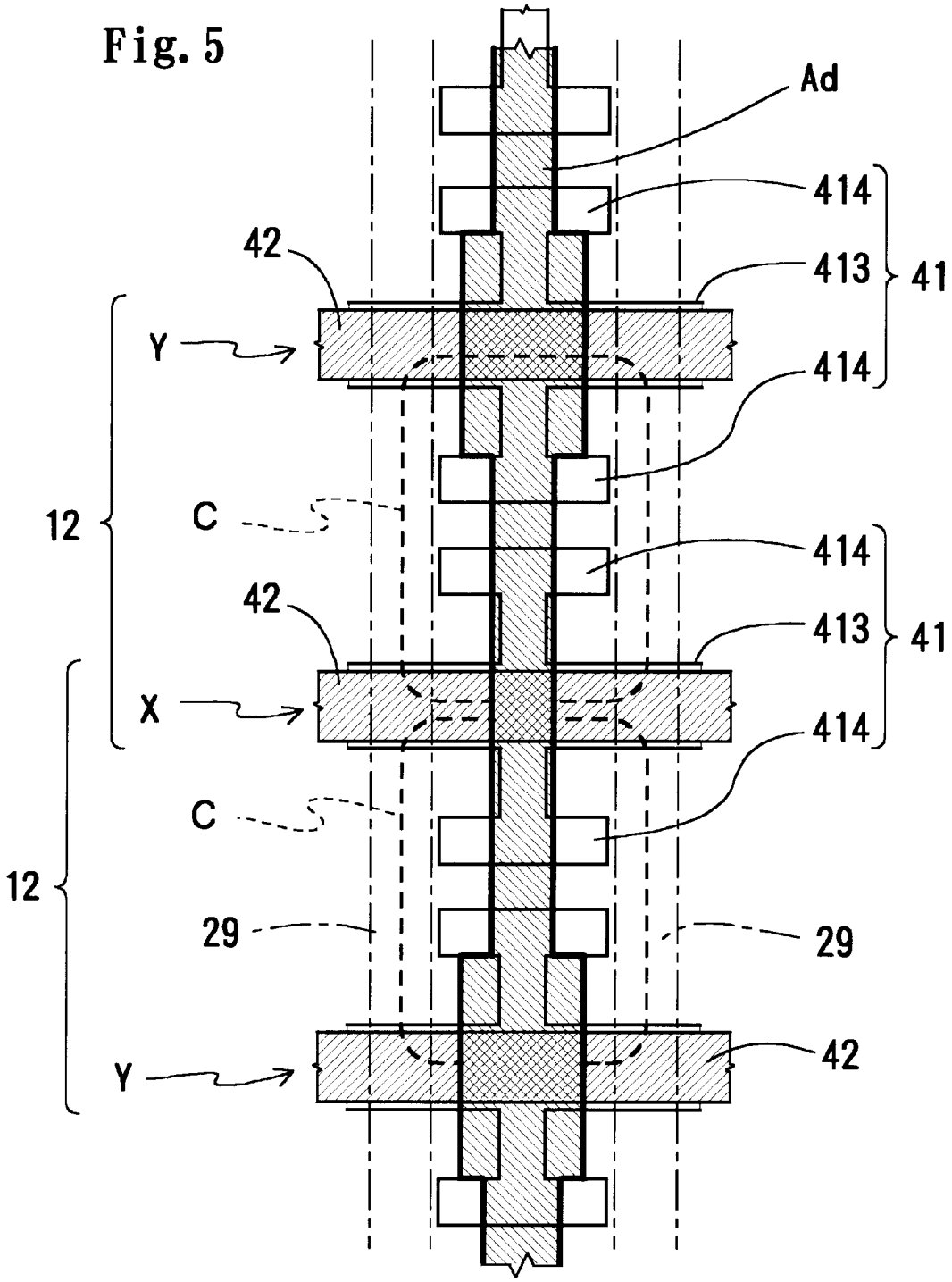
FIG. 5 shows a fourth example of the shape of the address electrode.

FIG. 5 shows a fourth example of the shape of the address electrode.

In FIG. 5, the address electrode Ad is patterned in a linear ribbon shape, whose width varies periodically in such a way that the width is larger at the portion where the main electrode Y overlays the transparent conductive film 41 than the other portion and is arranged in the center portion of the column in the row direction. The small width of the electrode makes the area of the main electrode X opposed to the address electrode A smaller than the area of the main electrode Y opposed to the address electrode A, so that the spread of the address discharge is prevented. The transparent conductive film 41 of the main electrode Y and the main electrode X is patterned in the shape having a linear portion 413 extending along the full length of the screen in the row direction and the T-shaped portion 414 that protrudes at each end of the linear portion 413 of each column. The metal film 42 overlays the linear portion 413 completely in the screen. The length of the portion of the address electrode Ad whose width is large is set within a range of the head to head distance between the pair of T-shaped portions 414 extending in the row direction, considering the effect of preventing the spread of address discharge.

Figure 6:
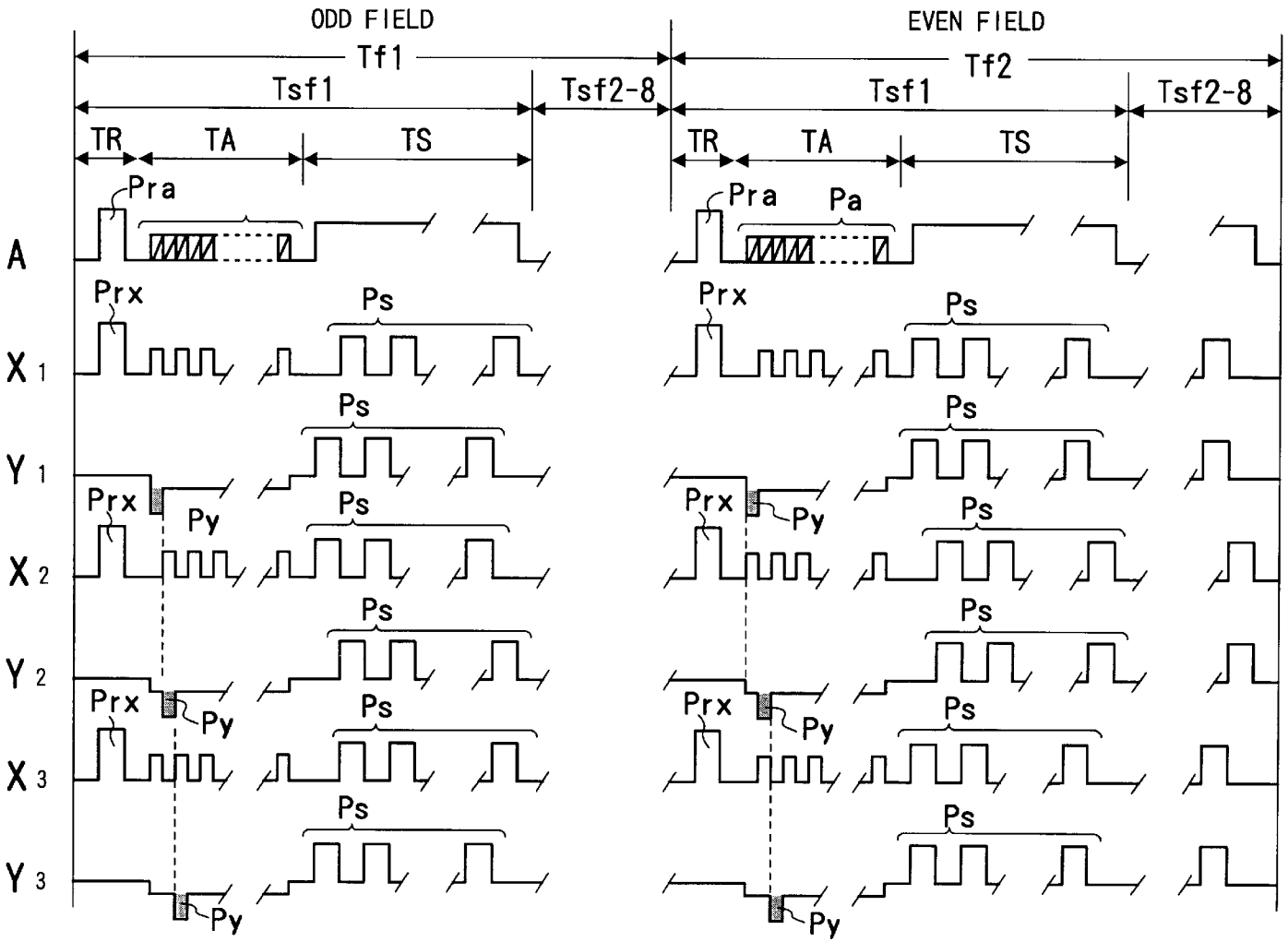
FIG. 6 shows voltage waveforms in an example of a drive sequence.

FIG. 6 shows voltage waveforms in an example of a drive sequence.

The plasma display panel 1 is driven by dividing a frame, that is, image information of a scene, into an odd field and an even field. Then, an odd row is displayed in an odd field period Tf1, and an even row is displayed in the even field period Tf2. Namely, the information of one scene is displayed by an interlace format.

Each of the odd field and the even field is divided into eight subframes for example, so that gradation display (color reproduction) is performed by controlling on and off in binary value. In other words, each field is replaced with a set of eight subframes. The relative intensity ratios of these subfields are set to approximately 1:2:4:8:16:32:64:128, so that the number of sustaining discharge for each subfield is determined. Since 256 steps of intensity can be set for each color of red, green and blue by the combination of on and off for each subfield, $256_3$ colors can be reproduced. However, it is not necessary to display the subfields in the order of the intensity.

The subfield period ($Tsf_j$(j='1–8)) assigned to each subfield includes a preparation period TR for equalizing charge distribution in the entire screen, an addressing period TA for forming charge distribution corresponding to the contents of display, a sustaining period TS for sustaining the on state to secure the intensity corresponding to the gradation level. In each subfield period $Tsf_j$, the length of the addressing preparation period TR and the addressing period TA is constant despite the weight of the intensity, but the length of the sustaining period TS is larger, for a larger weight of the intensity. Namely, the respective lengths of the eight subfield periods $Tsf_j$ corresponding to one field f are different from each other.

As shown in FIG. 6, concerning each subfield of the odd field, a write pulse Prx having a peak level larger than the discharge starting voltage is first applied to each of the main electrodes X in the preparation period TR. On this occasion, a pulse Pra for canceling the write pulse Prx is applied to each of the address electrode A. The application of the write pulse Prx causes the surface discharge and so that excessive wall charge is generated in each cell, and the wall charge will disappear substantially by self erase discharge at the falling edge of the pulse. Next, in the addressing period TA, a scanning pulse Py is applied to each main electrode Y sequentially for the row selection. In synchronization with the scanning pulse Py, an addressing pulse Pa is applied to the address electrode A corresponding to the cell to be lightened in the selected row so that the address discharge is generated. In addition, the pulse is applied alternately to the odd number of the main electrode X and the even number of the main electrode X so that an appropriate surface discharge is generated in the odd row. In the sustaining period TS, a sustaining pulse Ps is applied to the main electrode X and the main electrode Y at the alternate timing for the odd row and at the simultaneous timing for the even row.

Concerning each subfield of the even field too, the write pulse Prx is applied to each of the main electrode X in the preparation period TR so as to erase the wall charge. In the addressing period TA too, the scanning pulse Py is applied to each main electrode Y sequentially in the same way as the odd field, and the addressing pulse Pa is applied to a predetermined address electrode A. However, in the even field, the pulse is applied alternately to the odd number of the main electrode X and the even number of the main electrode X in synchronization with the scanning pulse Py so that an appropriate surface discharge is generated in the even row. In addition, the sustaining pulse Ps is applied to the main electrode X and the main electrode Y in the sustaining period TS, at the alternate timing for the even row and at the simultaneous timing for the odd row.

In the above-explained example, the structure of the PDP (so-called a reflection type) in which the main electrodes are arranged on the front side substrate is illustrated.

However, the present invention can be applied to the other structure (a transparent type) in which the main electrodes are arranged on the backside substrate. In the case of the transparent type, the main electrode can be made of a non-transparent material such as a metal film. The shape of the main electrode can be changed within the range where the discharge characteristics of each row can remain uniform. In addition, the present invention can be applied to a three-electrode structure in which a pair of main electrodes is arranged for each row.

As explained above, the present invention can provide a PDP with high accuracy of addressing by suppressing the spread of address discharge in the column direction and a high definition display without errors.

What is claimed is:

1. A plasma display panel having a screen, comprising:

a plurality of first main electrodes for row selection;

a plurality of second main electrodes, arranged alternately with the plurality of first main electrodes, defining electrode pairs with respective ones of the plural first main electrodes, each pair defining a corresponding row in which surface discharges are produced;

a plurality of address electrodes for column selection;

a plurality of partitions, each adjacent pair thereof defining therebetween a discharge space of a corresponding column and each column being continuous over a full length of the screen;

each of the first main electrodes and of the second main electrodes including a transparent conductive film securing an electrode area and a metal film reducing electrical resistance; and each of the address electrodes crossing the respective metal films of the first main electrodes and being formed into a band-like structure, whose shape is changed periodically such that a first area of the band-like structure, adjacent and corresponding to the metal film of the second main electrode, is outside of a second area between the respective, adjacent partitions of each column of the screen and a third area of the band-like structure, opposed to the metal film of the first main electrode, is inside the second area between the respective, adjacent partitions of each column of the screen.

2. The plasma display panel according to claim 1, wherein the first main electrodes and the second main electrodes are spaced uniformly.

3. The plasma display panel according to claim 1, wherein the first main electrodes and the second main electrodes are spaced uniformly and the respective, transparent conductive films of the first main electrodes and the second main electrodes are patterned in a T-shape and so as to protrude from each end of the metal film, overlaying thereon in the column direction.

4. The plasma display panel according to claim 1, wherein each of the address electrodes crosses the metal film of the first main electrodes at the center of the second area in the row direction.

5. A plasma display panel having a screen, comprising:

a plurality of first main electrodes for row selection;

a plurality of second main electrodes, arranged alternately with the plurality of first main electrodes, defining electrode pairs with respective ones of the plural first main electrodes, each pair defining a corresponding row in which surface discharges are produced;

a plurality of address electrodes for column selection;

a plurality of partitions, each adjacent pair thereof defining therebetween a discharge space of a corresponding column and each column being continuous over a full length of the screen;

each of the first main electrodes and of the second main electrodes including a transparent conductive film securing an electrode area and a metal film reducing electrical resistance; and each of the address electrodes crossing at least the respective metal films of the first main electrodes and being formed into a band-like structure, whose shape is changed periodically such that a first area thereof, opposed to the metal film of the second main electrode, is smaller than a second area thereof, opposed to the metal film of the first main electrode, in a third area between the respective, adjacent partitions of each column of the screen, wherein each of the address electrodes is patterned in a linear ribbon shape of a periodically changing width so that a width of first portions thereof crossing the metal films of the first main electrodes is larger than that of second portions thereof crossing the metal films of the second main electrodes.

6. A plasma display panel having a screen, comprising:

a plurality of first main electrodes for row selection;

a plurality of second main electrodes, arranged alternately with the plurality of first main electrodes, defining electrode pairs with respective ones of the plural first main electrodes, each pair defining a corresponding row in which surface discharges are produced;

a plurality of address electrodes for column selection;

a plurality of partitions, each adjacent pair thereof defining therebetween a discharge space of a corresponding column and each column being continuous over a full length of the screen;

each of the first main electrodes and of the second main electrodes including a transparent conductive film securing an electrode area and a metal film reducing electrical resistance; and each of the address electrodes crossing at least the respective metal films of the first main electrodes and being formed into a band-like structure, whose shape is changed periodically such that a first area thereof, opposed to the metal film of the second main electrode, is smaller than a second area thereof, opposed to the metal film of the first main electrode, in a third area between the respective, adjacent partitions of each column of the screen, wherein the first main electrodes and the second main electrodes are spaced uniformly, the transparent conductive films of the first main electrodes and the second main electrodes are patterned in a T-shape and so as to protrude from each end of the metal film overlaying thereon in the column direction, each of the address electrodes is patterned in a linear ribbon shape of a periodically changing width, the width of first portions thereof crossing the metal films of the first main electrodes is larger than that of second portions thereof crossing the metal films of the second main electrodes, and each of the address electrodes is arranged at a center of a third area in the row direction.

7. A method for driving a plasma display panel having a screen and including a plurality of first main electrodes for row selection, a plurality of second main electrodes, spaced uniformly from and arranged alternately with the plurality of first main electrodes, defining electrode pairs with respective ones of the plural first main electrodes, each pair defining a corresponding row in which surface discharges are produced, a plurality of address electrodes for column selection, a plurality of partitions, each adjacent pair thereof defining therebetween a discharge space of a corresponding column and each column being continuous over a full length of the screen, each of the first main electrodes and of the second main electrodes including a transparent conductive film securing an electrode area and a metal film reducing electrical resistance, and each of the address electrodes crossing the respective metal films of the first main electrodes and being patterned such that a first area of each of the address electrodes, adjacent and corresponding to the metal film of the second main electrode, is outside of a second area between the respective, adjacent partitions of each column of the screen and a third area of each of the address electrodes, opposed to the metal film of the first main electrode, is inside the second area between the respective, adjacent partitions of each column of the screen, the method comprising:

alternately displaying odd fields and even fields of an object image;

controlling potentials of each of the first main electrodes and the address electrodes independently so as to perform addressing of odd rows, and then periodically applying a voltage, for generating surface discharges to the electrode pair of the odd row, while displaying odd fields; and controlling potentials of each of the first main electrodes and the address electrodes, one by one, so as to perform addressing of even rows, and then periodically applying a voltage for generating surface discharges to the respective electrode pairs of the even rows, while displaying even fields.

8. A plasma display panel having a screen, comprising:

a plurality of first main electrodes for row selection;

a plurality of second main electrodes, arranged alternately with the plurality of first main electrodes, defining electrode pairs with respective ones of the plural first main electrodes, each pair defining a corresponding row, in which surface discharges are produced;

a plurality of address electrodes for column selection;

a plurality of partitions, each adjacent pair thereof defining therebetween a discharge space of a corresponding column and each column being continuous over a full length of the screen; and each of the plural address electrodes is patterned in a meandering form so as to cross the first main electrodes and not to cross the second main electrodes, in an entire area between the respective, adjacent partitions of each column of the screen.

9. The plasma display panel according to claim 8, wherein the portions of the address electrodes crossing the second main electrodes are insulated by the corresponding partitions from the respective discharge spaces.

10. The plasma display panel according to claim 8, wherein the first main electrodes and the second main electrode are spaced uniformly.

11. The plasma display panel according to claim 8, wherein the first main electrodes and the second main electrodes are spaced uniformly and respective, transparent conductive films of the first main electrodes and the second main electrodes are patterned in a T-shape and so as to protrude at each end of respective metal films of the first and second main electrodes overlaying thereon in the column direction.

12. A method for driving a plasma display panel having a screen and including a plurality of first main electrodes for row selection, a plurality of second main electrodes, spaced uniformly from and arranged alternately with the plurality of first main electrodes, defining electrode pairs with respective ones of the plural first main electrodes, each pair defining a corresponding row in which surface discharges are produced, a plurality of address electrodes for column selection, a plurality of partitions, each adjacent pair thereof defining therebetween a discharge space of a corresponding column and each column being continuous over a full length of the screen, each of the first main electrodes and of the second main electrodes including a transparent conductive film securing an electrode area and a metal film reducing electrical resistance, and each of the address electrodes crossing the respective metal films of the first main electrodes and being formed into a band-like structure, whose shape is changed periodically in a first area, between the respective, adjacent partitions of each column of the screen, each of the address electrodes crossing the respective metal films of the first main electrodes and being patterned such that a second area of each of the address electrodes, adjacent and corresponding to the metal film of the second main electrode, is outside of the first area between the respective, adjacent partitions of each column of the screen and a third area of each of the address electrodes, opposed to the metal film of the first main electrode, is inside the first area between the respective, adjacent partitions of each column of the screen, the method comprising:

alternately displaying odd fields and even fields of an object image;

controlling potentials of each of the first main electrodes and the address electrodes one by one so as to perform addressing of odd rows, and then periodically applying a voltage, for generating surface discharges, to the electrode pair of the odd row, while displaying odd fields; and controlling potentials of each of the first main electrodes and the address electrodes, one by one, so as to perform addressing of even rows, and then periodically applying a voltage, generating surface discharges to the respective electrode pairs of the even rows, while displaying even fields.

13. A plasma display panel having a screen, comprising:

a plurality of first main electrodes for row selection;

a plurality of second main electrodes, arranged alternately with the plurality of first main electrodes, defining electrode pairs with respective ones of the plural first main electrodes, each pair defining a corresponding row in which surface discharges are produced;

a plurality of address electrodes for column selection;

a plurality of partitions, each adjacent pair thereof defining therebetween a discharge space of a corresponding column and each column being continuous over a full length of the screen;

each of the first main electrodes and of the second main electrodes including a transparent conductive film securing an electrode area and a metal film reducing electrical resistance; and wherein the transparent conductive films of the first main electrodes and the second main electrodes are patterned in a T-shape so as to protrude from each end of the metal film overlaying thereon in a column direction, each of the address electrodes is patterned in a linear ribbon shape of a periodically changing width, a width of first portions thereof crossing the first main electrodes is larger than that of second portions thereof crossing the metal films of the second main electrodes, and a length of the first portions of the address electrodes, whose widths are large, is set within a range of a head to head distance between a pair of T-shaped portions extending in a row direction in the transparent conductive films of the first main electrodes.

14. A plasma display panel having a screen, comprising:

a plurality of first main electrodes for row selection;

a plurality of second main electrodes, arranged alternately with the plurality of first main electrodes, defining electrode pairs with respective ones of the plural first main electrodes, each pair defining a corresponding row in which surface discharges are produced;

a plurality of address electrodes for column selection;

a plurality of partitions, each adjacent pair thereof defining therebetween a discharge space of a corresponding column and each column being continuous over a full length of the screen; and wherein each of the first main electrodes and of the second main electrodes is patterned in a shape having a linear portion extending along the full length of the screen in a row direction and a T-shaped portion protruding at each end in a column direction from the linear portion of each column, each of the address electrodes is patterned in a linear ribbon shape of a periodically changing width, a width of first portions thereof crossing the first main electrodes is larger than that of second portions thereof crossing the metal films of the second main electrodes, and a length of the first portions of the address electrodes, whose width are large, is set within a range of a head to head distance between a pair of T-shaped portions extending in the row direction in the first main electrodes.

15. A plasma display panel having a screen, a plurality of first main electrodes for row selection, a plurality of second main electrodes, arranged alternately with the plurality of first main electrodes, defining electrode pairs with respective ones of the plural first main electrodes, each pair defining a corresponding row in which surface discharges are produced, and a plurality of address electrodes for column selection, comprising:

a plurality of partitions, each adjacent pair thereof defining therebetween a discharge space of a corresponding column;

each of the first main electrodes and of the second main electrodes including a metal film reducing electrical resistance; and each of the address electrodes crossing only the respective metal films of the first main electrodes and being formed into a contoured band, whose contour changes in an area between the respective, adjacent partitions of each column of the screen.

16. A plasma display panel having a screen, comprising:

a plurality of first main electrodes for row selection;

a plurality of second main electrodes, arranged alternately with the plurality of first main electrodes, defining electrode pairs with respective ones of the plural first main electrodes, each pair defining a corresponding row in which surface discharges are produced;

a plurality of address electrodes for column selection;

a plurality of partitions, each adjacent pair thereof defining therebetween a discharge space of a corresponding column and each column being continuous over a full length of the screen;

each of the first main electrodes and of the second main electrodes including a transparent conductive film securing an electrode area and a metal film reducing electrical resistance; and wherein the transparent conductive films of the first main electrodes and the second main electrodes are patterned in a T-shape so as to protrude from each end of the metal film overlaying thereon in a column direction, and each of the address electrodes is patterned in a meandering ribbon shape so as to cross both the respective transparent conductive films and the respective metal films of the first main electrodes inside an area between the respective, adjacent partitions of each column of the screen, and so as to cross only the respective metal films of the second main electrodes outside the area between the respective, adjacent partitions of each column of the screen.

17. A plasma display panel having a screen, comprising:

a plurality of first main electrodes for row selection;

a plurality of second main electrodes, arranged alternately with the plurality of first main electrodes, defining electrode pairs with respective ones of the plural first main electrodes, each pair defining a corresponding row in which surface discharges are produced;

a plurality of address electrodes for column selection;

a plurality of partitions, each adjacent pair thereof defining therebetween a discharge space of a corresponding column and each column being continuous over a full length of the screen; and wherein each of the address electrodes is patterned in a meandering ribbon shape so as to traverse an area between the respective, adjacent partitions of each column of the screen and to partially overlay both of the respective, adjacent partitions of each column of the screen, each of the address electrodes crossing the first main electrodes inside the area between the respective, adjacent partitions of each column of the screen and crossing the second main electrodes outside the area between the respective, adjacent partitions of each column of the screen.

18. A plasma display panel having a screen, comprising:

a plurality of first main electrodes for row selection;

a plurality of second main electrodes defining electrode pairs with respective ones of the plural first main electrodes, each pair defining a corresponding row in which surface discharges are produced;

a plurality of address electrodes for column selection;

a plurality of partitions, each adjacent pair thereof defining therebetween a discharge space of a corresponding column and each column being continuous over a full length of the screen; and wherein each of the address electrodes is patterned in a linear ribbon shape and has one or more slits formed only in portions thereof where the address electrodes cross the second main electrodes.

* * * * *